US007242891B2

(12) United States Patent
Shin

(10) Patent No.: US 7,242,891 B2
(45) Date of Patent: Jul. 10, 2007

(54) IMAGE FORMING APPARATUS AND METHOD THEREOF

(75) Inventor: Joong-gwang Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 226 days.

(21) Appl. No.: 11/033,378

(22) Filed: Jan. 12, 2005

(65) Prior Publication Data

US 2005/0180776 A1 Aug. 18, 2005

(30) Foreign Application Priority Data

Feb. 17, 2004 (KR) ..... 10-2004-0010358

(51) Int. Cl.
*G03G 15/02* (2006.01)

(52) U.S. Cl. ..... 399/176; 399/315

(58) Field of Classification Search ..... 399/176, 399/175, 174, 315

See application file for complete search history.

(56) References Cited

U.S. PATENT DOCUMENTS

| | | | | |
|---|---|---|---|---|
| 5,126,913 | A * | 6/1992 | Araya et al. | 361/225 |
| 5,589,922 | A * | 12/1996 | Amemiya et al. | 399/315 |
| 5,946,538 | A * | 8/1999 | Takeuchi et al. | 399/302 |
| 6,029,022 | A * | 2/2000 | Takase | 399/66 |
| 6,070,043 | A | 5/2000 | Fujita et al. | |
| 6,233,422 | B1 * | 5/2001 | Abe et al. | 399/303 |
| 6,915,092 | B2 * | 7/2005 | Yamaguchi et al. | 399/109 |
| 2003/0068179 | A1 * | 4/2003 | Horrall et al. | 399/299 |
| 2004/0126142 | A1 * | 7/2004 | Toba et al. | 399/227 |

FOREIGN PATENT DOCUMENTS

| | | |
|---|---|---|
| JP | 5-53392 | 3/1993 |
| JP | 2001-56612 | 2/2001 |
| JP | 2001-154513 | 6/2001 |
| KR | 2001-47492 | 6/2001 |
| KR | 2003-63534 | 7/2003 |

OTHER PUBLICATIONS

Korean Office Action issued Nov. 18, 2005 in corresponding Korean application.

* cited by examiner

*Primary Examiner*—Anjan Deb
(74) *Attorney, Agent, or Firm*—Stanzione & Kim, LLP

(57) ABSTRACT

An image forming apparatus includes an image-forming unit having a plurality of photosensitive media to be charged; a transfer belt to be rotated along an endless path by a drive roller and a steering roller, an outer surface of the transfer belt being in contact with a surface of each of the plurality of photosensitive media; a transfer voltage applying unit to apply a predetermined transfer voltage to the transfer belt to transfer a toner image formed on the surface of each of the plurality of photosensitive media to the transfer belt by an electrostatic force; and a residual electrical charge removing unit to remove an electrical charge transferred from the plurality of photosensitive media to the transfer belt according to the applied transfer voltage to prevent the electrical charge from being accumulated on the transfer belt. Therefore, an electrical charge accumulation on the transfer belt is prevented, and a decrease of transfer voltage and a subsequent deterioration of the transfer efficiency can be prevented.

26 Claims, 3 Drawing Sheets

IMAGE FORMING APPARATUS AND METHOD THEREOF

CROSS-REFERENCE TO RELATED APPLICATIONS

This application claims the benefit of Korean Patent Application No. 2004-10358 filed Feb. 17, 2004, in the Korean Intellectual Property Office, the disclosure of which is incorporated herein in its entirety and by reference.

BACKGROUND OF THE INVENTION

1. Field of the Invention

The present general inventive concept relates to an image forming apparatus such as a printer, a facsimile, or a copier, and a method thereof, and more particularly, to an electro-photographic image forming apparatus and a method thereof.

2. Description of the Related Art

An electro-photographic image forming apparatus scans a laser beam to a surface of a photosensitive medium charged with a predetermined electrical potential and forms an electrostatic latent image thereon. After the electrostatic latent image is developed with a predetermined color toner, a complete color image is formed on a surface of a transfer belt as respective color toner images are transferred to the transfer belt to be sequentially formed on one another. A sheet of printing paper stacked in a paper cassette is delivered to a transfer roller rotating in contact with the transfer belt by a pick-up roller, and the color image is transferred thereto. The color image transferred onto the printing paper is fixed on the printing paper by a fixing part. The printing paper on which the image is fixed is discharged outside the image forming apparatus.

FIG. 1 schematically shows a conventional electro-photographic image forming apparatus.

Referring to FIG. 1, the electro-photographic image forming apparatus includes an image forming unit having a plurality of photosensitive media 10 to be charged, a light exposing unit 20 scanning a laser beam onto a surface of each of the plurality of photosensitive media 10 and forming a predetermined electrostatic latent image thereon, and a plurality of developing units 30 developing the electrostatic latent image with color toners, a transfer belt 40 being supported by a drive roller 41 and a steering roller 42 to rotate endlessly in a closed loop while being in contact with the plurality of photosensitive media 10, a transfer voltage applying unit 50 applying a predetermined transfer voltage to the transfer belt 40 for transferring a toner image formed on the surface of each of the plurality of photosensitive media 10 to the transfer belt 40, and a transfer roller 60 being disposed outside the transfer belt to correspond to the drive roller 41 for transferring the toner image transferred onto the surface of the transfer belt 40 to a sheet of printing paper P delivered from a paper cassette (not shown).

The transfer voltage applying unit 50 has a plurality of voltage applying rollers 51 and a voltage applying part 52. The plurality of voltage applying rollers 51 are arranged inside the transfer belt 40 to be in contact with an inner surface thereof and to correspond to each of the plurality of photosensitive media 10. A transfer voltage having an opposite polarity of the toner is applied from the voltage applying part 52 to the plurality of the voltage applying rollers 51.

Therefore, the toner image formed on each of the plurality of photosensitive media 10 is transferred to the transfer belt 40 by an electrostatic force generated between each of the plurality of photosensitive media 10 and the transfer belt 40 by the transfer voltage applying unit 50. When toner images transferred as mentioned above are sequentially formed on one another, a complete color image is formed on the surface of the transfer belt 40. The color image formed on the transfer belt 40 is transferred to the printing paper P by a mechanical force generated between the drive roller 41 and the transfer roller 60 and an electrostatic force generated between the transfer belt 40 and the transfer roller 60.

Here, the transfer voltage applied when the toner images are transferred from the plurality of photosensitive media 10 to the transfer belt 40, is approximately −1 KV, when a plus (positive) toner having a positive potential is used. At this time, an electrical potential of the transfer belt 40 is 0 KV. The toner image on the surface of each of the plurality of photosensitive media 10 is transferred to the transfer belt 40 by the electrical potential difference between the transfer belt and the toner.

However, in the conventional electro-photographic image forming apparatus as described above, the electrical charge (a positive electrical charge when the positive toner is used, a negative electrical charge when negative toner is used) of the photosensitive medium 10 moves to the transfer belt 40 and accumulates on the surface of the transfer belt 40, when the transfer voltage is applied to transfer the toner images from the plurality of photosensitive media 10 to the transfer belt 40. During printing, the electrical charge is accumulated on the surface of the transfer belt 40. As shown in FIG. 3A, the surface electrical potential of the transfer belt 40 is changed as time passes. As a result, the transfer voltage is decreased as the printing operation continues. Therefore, there is a problem of a lowered transferring efficiency and subsequent decrease of an image density.

SUMMARY OF THE INVENTION

The present general inventive concept provides an electro-photographic image forming apparatus which provides improved transferring efficiency by preventing an electrical charge from accumulating on a surface of a transfer belt.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an electro-photographic image forming apparatus comprising an image-forming unit having a plurality of photosensitive media to be charged, a transfer belt to be rotated along an endless path by a drive roller and a steering roller, an outer surface of the transfer belt being in contact with a surface of each of the plurality of photosensitive media, a transfer voltage applying unit to apply a predetermined transfer voltage to the transfer belt to transfer a toner image formed on the surface of each of the plurality of photosensitive media to the transfer belt by an electrostatic force, and a residual electrical charge removing unit to remove an electrical charge transferred from the plurality of photosensitive media to the transfer belt by the applied transfer voltage so that the transferred electrical charge is prevented from being accumulated on the transfer belt.

The residual electrical charge removing unit may comprise a residual electrical charge removing member disposed to be in contact with the outer surface of the transfer belt, and supported by the steering roller used as a back-up roller, wherein the residual electrical charge removing member applies to the back-up roller a voltage having a polarity opposite to a polarity of the electrical charge of the transfer belt, thereby discharging the electrical charge remaining on the transfer belt.

The transfer voltage applying unit may comprise a plurality of voltage applying rollers disposed to be in contact with an inner surface of the transfer belt inside the transfer belt and to correspond to each of the plurality of photosensitive media; and a voltage applying part to apply a transfer voltage to each of the plurality of voltage applying rollers. Also, a voltage is applied from the voltage applying part to the residual electric charge removing member. At this time, the voltage applied to the residual electric charge removing member is the same amplitude and timing as the voltage applied to the voltage applying roller.

The steering roller may be grounded so that a voltage efficiently may be applied to the residual electric charge removing member.

The residual electric charge removing member may be a roller rotated by the transfer belt or a brush which is in sliding-contact with the transfer belt.

The residual electric charge removing member may be made of a conductive material, but it can be made of a conductive and nonmetallic material.

The foregoing and/or other aspects and advantages of the present general inventive concept may be achieved by providing an electro-photographic image forming apparatus comprising a plurality of photosensitive media to be charged, a light exposing unit to scan a laser beam to each of the plurality of photosensitive media and to form a predetermined latent image thereon, a plurality of developing units to develop the latent image on each of the plurality of photosensitive media with each of color toners, a transfer belt to be rotated along an endless path by a drive roller and a steering roller, an outer surface of the transfer belt being in contact with the plurality of photosensitive media, a plurality of voltage applying rollers being disposed to be in contact with an inner surface of the transfer belt, and to correspond to each of the plurality of photosensitive media, a voltage applying part to apply a transfer voltage to the plurality of voltage applying rollers to transfer a toner image formed on a surface of each of the plurality of photosensitive media to the transfer belt using an electrostatic force, a transfer roller disposed outside the transfer belt to correspond to the drive roller, and to transfer the toner image transferred on the transfer belt to a sheet of printing paper, and a residual electrical charge removing member disposed to be in contact with the outer surface of the transfer belt, supported by the steering roller used as a back-up roller, wherein the residual electrical charge removing member applies a charge to the back-up roller, thereby discharging an electric charge remaining on the transfer belt using the voltage applied from the voltage applying part so that the electric charge does not accumulate on the transfer belt.

Since the electrical charge transferred from the plurality of photosensitive media to the transfer belt is discharged and removed by the residual electric charge removing member, the electrical charge does not accumulate on the transfer belt. Therefore, an electrical charge accumulation on the transfer belt is prevented, and a decrease of a transfer voltage and a subsequent deterioration of the transfer efficiency can be prevented.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
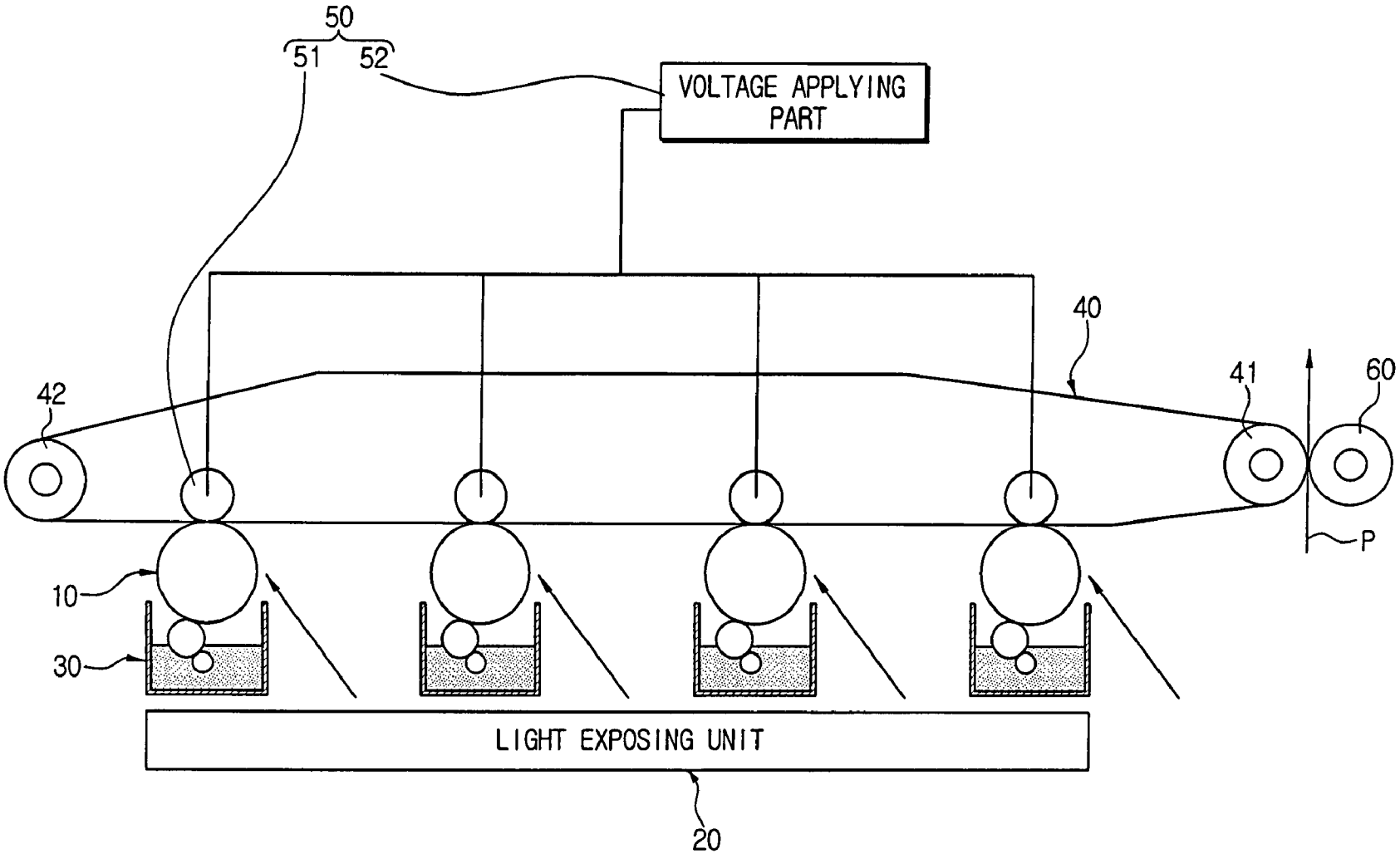
FIG. 1 (PRIOR ART)
FIG. 1 is a schematic view showing a conventional electro-photographic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description such as a detailed construction and elements are nothing but the ones provided to assist in a comprehensive understanding of the invention. Thus, it is apparent that the present general inventive concept can be carried out without those defined matters. Also, well-known functions or constructions are not described in detail since they would obscure the invention in unnecessary detail.

Figure 2:
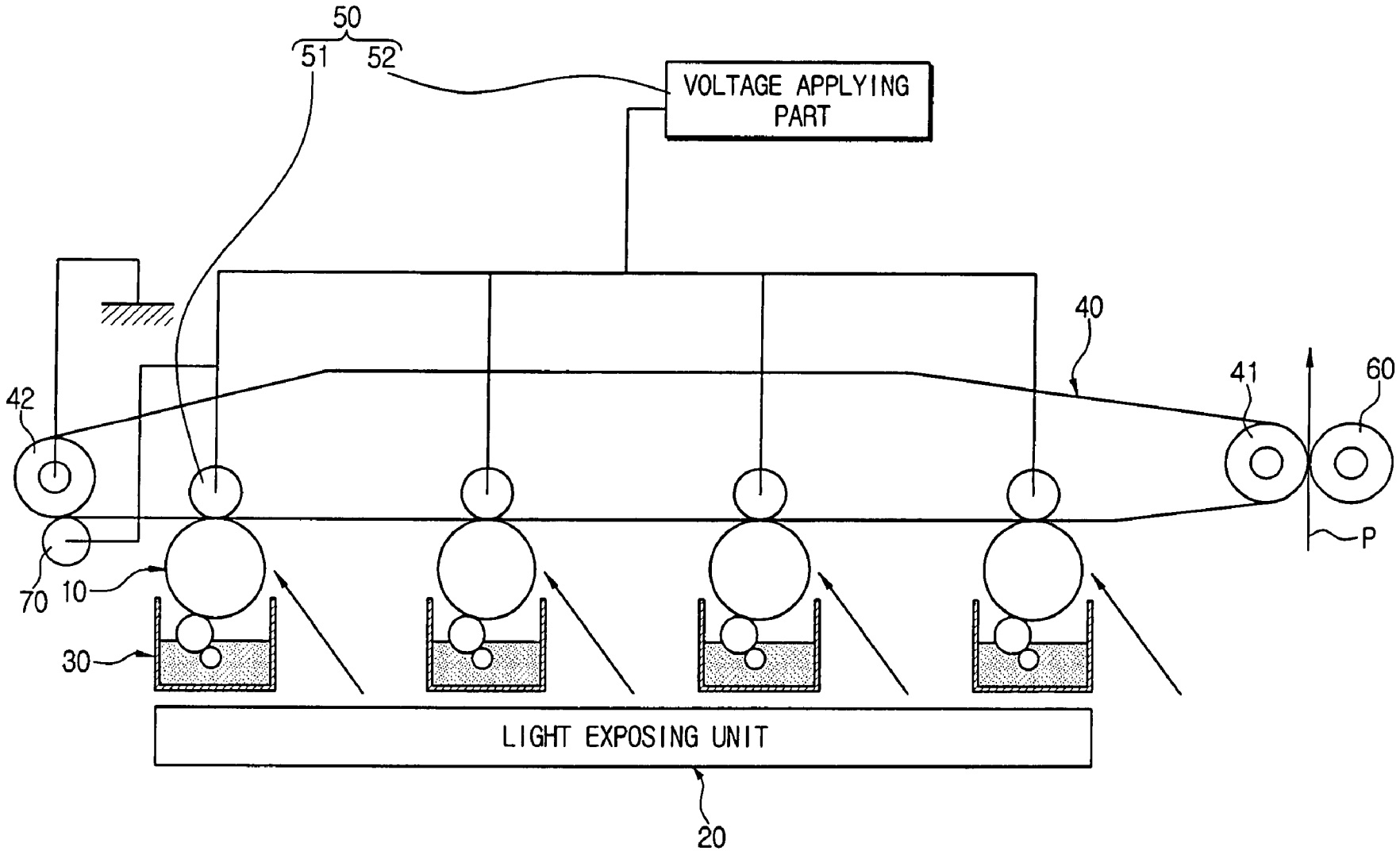
FIG. 2 is a schematic view showing an electro-photographic image forming apparatus according to an embodiment of the present general inventive concept.

FIG. 2 is a schematic view of an electro-photographic image forming apparatus according to an embodiment of the present general inventive concept.

Referring to FIG. 2, the electro-photographic image forming apparatus comprises an image forming unit having a plurality of photosensitive media 10 and forming predetermined color toner images on corresponding ones of the plurality of photosensitive media 10, a transfer belt 40 to which the color toner images formed by the image forming unit are transferred to form a color image, a transfer voltage applying unit 50 to apply a predetermined transfer voltage to the transfer belt 40 to transfer the color image of the image forming unit to the transfer belt 40 by an electrostatic force, a transfer roller 60 to transfer the image transferred to the transfer belt 40 to a sheet of printing paper P delivered from a paper cassette (not shown), and a residual electric charge removing unit 70 to remove an electrical charge transferred from the plurality of photosensitive media 10 to the transfer belt 40 so that the applied transfer voltage is prevented from being accumulated on the transfer belt 40.

The image forming unit comprises a light exposing unit 20 to scan a laser beam onto a surface of each of the plurality of photosensitive media 10 to form a predetermined electrostatic latent image thereon to print, and a plurality of developing units 30 to develop the electrostatic latent image with a predetermined color toner and forming the color toner image, respectively.

The transfer belt 40 is supported by a drive roller 41 and a steering roller 42 to rotate endlessly in a closed loop, and is in contact with the plurality of photosensitive media 10 at its outer circumference.

The transfer voltage applying unit 50 comprises a plurality of voltage applying rollers 51 and a voltage applying part 52. Each of the plurality of voltage applying rollers 51 is disposed inside the transfer belt 40 to be in contact with inner surface of the transfer belt 40 and to correspond to each of the plurality of photosensitive media 10. The voltage applying part 52 applies a predetermined transfer voltage to each of the voltage applying rollers 51. The polarity of the transfer voltage is opposite to the polarity of a potential of the color toner used to develop the latent image. In other words, when a positive toner having a positive potential is used, the transfer voltage is approximately −1 kilovolt (KV). At this time, it is possible that a surface electrical potential of the transfer belt 40 is 0 KV.

The transfer roller 60 is disposed outside the transfer belt 40 to correspond to the drive roller 41, and transfers the color image transferred onto the surface of the transfer belt 40 to the sheet of printing paper P. At this time, the color image on the transfer belt 40 is transferred to the printing paper P using a mechanical force generated between the drive roller 41 and the transfer roller 60 and/or an electrostatic force generated between the transfer belt 40 and the transfer roller 60.

The residual electric charge removing member 70 may be a roller that is supported by the steering roller 42 of the transfer belt 40, used as a back-up roller, in contact with the outer surface of the transfer belt 40, and rotated by the transfer belt 40. The residual electric charge removing member 70 to which a voltage having an opposite polarity of the electrical charge remaining on the transfer belt 40 is applied discharges and removes the electrical charge remaining on the transfer belt 40.

According to an embodiment of the present general inventive concept, the voltage is applied from the voltage applying part 52 to the residual electric charge removing member 70. That is, when the transfer voltage is applied from the voltage applying part 52 to each of the plurality of voltage applying rollers 51, the voltage is applied to the residual electric charge removing member 70 with the same measure and timing.

In addition to the roller as shown in FIG. 2, the residual electric charge removing member 70 may take a variety of adequate configurations such as a brush to be slide-contact with the transfer belt 40.

The residual electric charge removing member 70 may be made of a conductive and metal material. However, a nonmetallic material having conductivity of electricity may also be used.

In the image forming apparatus according to one certain embodiment of the present general inventive concept, for more effective supply of voltage to the residual electric charge removing member 70, it is possible that the steering roller 42, which is used as a backup roller supporting the residual electric charge removing member 70, is grounded.

Hereinafter, an operation of the image forming apparatus comprising the same structure as that described above is explained.

When a printing signal is input, the light exposing unit 20 is operated, and the transfer belt 40 and the developing unit 30 are operated at the same time. A predetermined color toner image is formed on each of the plurality of photosensitive media 10 by the light exposing unit 20 and developing unit 30. Each of the color toner images formed on the plurality of photosensitive media 10 is first transferred to the transfer belt 40 by an electrostatic force operated between each of the plurality of photosensitive media 10 and the transfer belt 40 when the transfer voltage is applied to the plurality of voltage applying rollers 51.

At this time, as explained in the background of the invention, when the transfer voltage is applied to the plurality of voltage applying rollers 51, the positive electrical charge of the plurality of photosensitive media 10 is transferred to and accumulated upon the transfer belt 40 by an electric field when the positive toner (the color toner having a positive potential) is used. But the positive electrical charge transferred to and accumulated upon the transfer belt 40 is discharged and thus removed because a predetermined voltage having an opposite polarity is applied to the residual electric charge removing member 70 which is in contact with the transfer belt 40. Therefore the electrical charge is prevented from accumulating on the transfer belt 40.

Figure 3A:
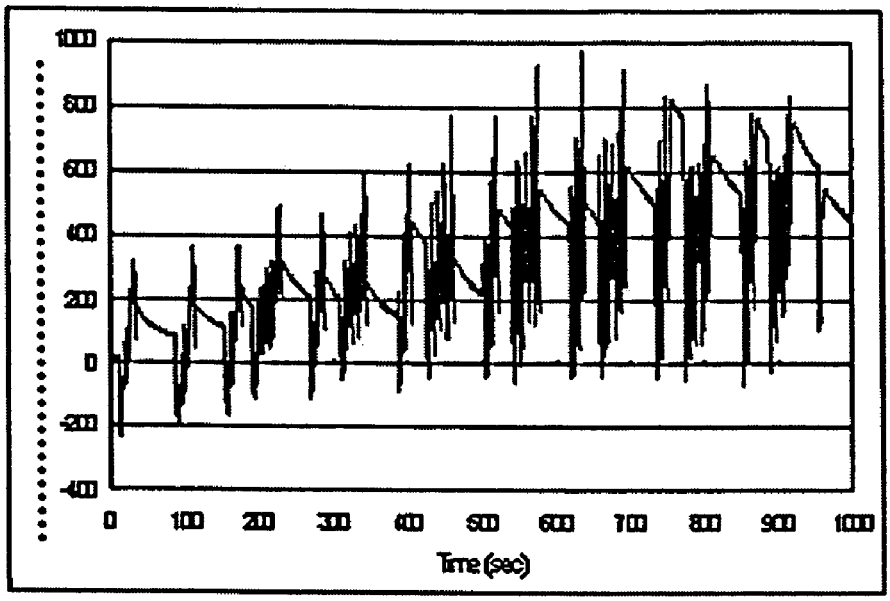
FIG. 3A (PRIOR ART)
FIGS. 3A and 3B are graphical representations showing a comparison of a surface electrical potential of a transfer belt between the conventional image forming apparatus of FIG. 1 and the image forming apparatus of FIG. 2, respectively.
Figure 3B:
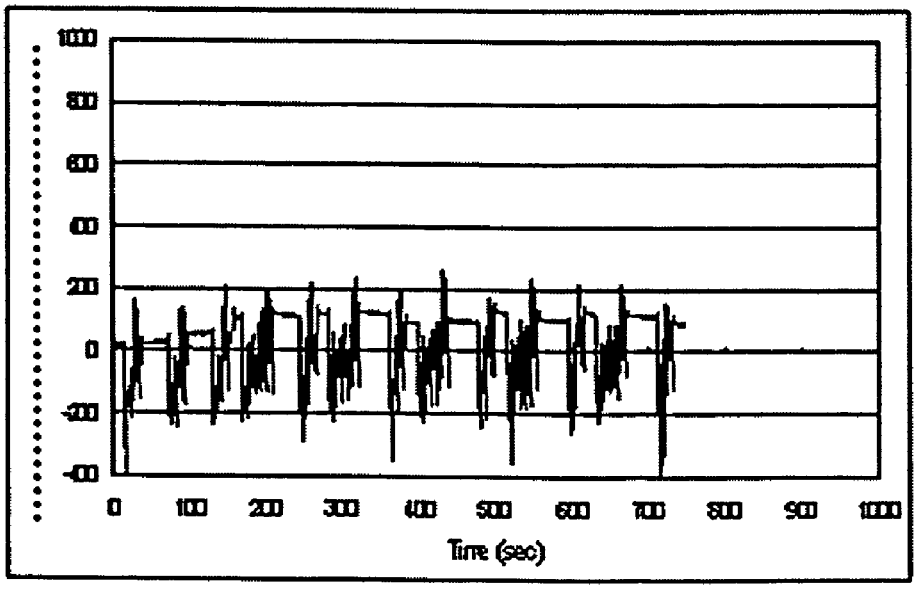

It is confirmed by a test that a surface electrical potential of the transfer belt 40 is kept stable as shown in FIG. 3B, when a voltage of approximately −1 KV is applied to the residual electric charge removing member 70.

FIG. 3A shows measured values of the surface electrical potential of the transfer belt with respect to a time axis in the conventional image forming apparatus of FIG. 1. FIG. 3B shows measured values of the surface electrical potential of the transfer belt of FIG. 2. Referring to FIGS. 3A and 3B, it is noted that the surface electrical potential of the transfer belt of the image forming apparatus according to the present general inventive concept does not vary greatly as time passes, while the surface electrical potential of the transfer belt of the conventional image forming apparatus varies irregularly.

The image transferred to the transfer belt 40 is transferred to the printing paper P passing through between the transfer roller 60 and the transfer belt 40 by the transfer roller 60 by the operation as described above. The printing paper P, to which the image is transferred, is passed trough a fixing part and discharged outside the image forming apparatus.

As described above, the electrical charge is not accumulated on the transfer belt because the electrical charge transferred from the photosensitive medium to the transfer belt during printing is discharged and removed by the residual electric charge removing member. Therefore, an electrical charge accumulation on the transfer belt is prevented, and a decrease of the transfer voltage and a subsequent deterioration of the transfer efficiency can be prevented. Additionally, image density does not deteriorate as the printing operation continues.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an image-forming unit comprising a plurality of photosensitive media to be charged;

a transfer belt to rotate along an endless path, and having an outer surface to contact a surface of each of the plurality of photosensitive media;

a driving roller and a steering roller to rotate the transfer belt;

a transfer voltage applying unit to apply a predetermined transfer voltage to the transfer belt to transfer a toner image formed on a surface of each of the plurality of photosensitive media to the transfer belt by an electrostatic force; and a residual electrical charge removing unit to remove an electrical charge transferred from the plurality of photosensitive media to the transfer belt according to the applied transfer voltage so that the electrical charge does not accumulate on the transfer belt, wherein the residual electrical charge removing unit comprises:

a residual electrical charge removing member disposed to be in contact with the outer surface of the transfer belt, and supported by the steering roller used as a back-up roller.

2. The image forming apparatus according to claim 1, wherein the residual electrical charge removing unit is charged with a voltage having a polarity opposite to a polarity of the electrical charge of the transfer belt so that the electrical charge remaining on the transfer belt is discharged.

3. The image forming apparatus according to claim 2, wherein the transfer voltage applying unit comprises:

a plurality of voltage applying rollers disposed to be in contact with an inner surface of the transfer belt and to correspond to each of the plurality of photosensitive media; and a voltage applying part to apply a transfer voltage to each of the plurality of voltage applying rollers, and to apply a voltage having the same measure and timing as the transfer voltage to the residual electrical charge removing member.

4. The image forming apparatus according to claim 3, wherein the steering roller is grounded.

5. The image forming apparatus according to claim 3, wherein the residual electric charge removing member comprises a roller rotated by the transfer belt.

6. The image forming apparatus according to claim 3, wherein the residual electric charge removing member comprises a brush to be slide contact with the transfer belt.

7. The image forming apparatus according to claim 3, wherein the residual electric charge removing member is made of a conductive material.

8. The image forming apparatus according to claim 3, wherein the residual electric charge removing member is made of a metallic material.

9. The image forming apparatus according to claim 1, wherein the steering roller is a backup roller of the residual electrical charge removing unit.

10. The image forming apparatus according to claim 1, wherein the transfer voltage applying unit comprises a plurality of voltage applying rollers to contact the transfer belt, and a voltage applying part to apply a first voltage to the voltage applying rollers and a second voltage to the residual electrical charge removing unit.

11. The image forming apparatus according to claim 10, wherein the first and second voltages have the same measure.

12. The image forming apparatus according to claim 10, wherein the steering roller is applied with a third voltage.

13. An image forming apparatus comprising:

a plurality of photosensitive media to be charged;

a light exposing unit to scan a laser beam to each of the plurality of photosensitive media to form a predetermined latent image thereon;

a plurality of developing units to develop the latent image on each of the plurality of photosensitive media with each of color toners;

a transfer belt to rotate along an endless path, and having an outer surface to contact the plurality of photosensitive media;

a drive roller and a steering roller to rotate the transfer belt;

a plurality of voltage applying rollers disposed to be in contact with an inner surface of the transfer belt, and to correspond to each of the plurality of photosensitive media;

a voltage applying part to apply a transfer voltage to the plurality of voltage applying rollers, and to transfer a toner image formed on a surface of each of the plurality of photosensitive media to the transfer belt by an electrostatic force;

a transfer roller disposed outside the transfer belt to correspond to the drive roller, and to transfer the toner image transferred on the transfer belt to a sheet of printing paper; and a residual electrical charge removing member disposed to be in contact with the outer surface of the transfer belt, supported by the steering roller used as a back-up roller, wherein the residual electrical charge removing member discharges an electric charge remaining on the transfer belt with the voltage applied from the voltage applying part.

14. The image forming apparatus according to claim 13, wherein the residual electrical charge removing member comprises a roller rotated by the transfer belt.

15. The image forming apparatus according to claim 13, wherein the residual electrical charge removing member comprises a brush to be slide-contact with the transfer belt.

16. The image forming apparatus according to claim 13, wherein the voltage applied to the residual electric charge removing member is the same in measure and timing as the transfer voltage.

17. The image forming apparatus according to claim 13, wherein the steering roller is grounded.

18. A method of discharging a remaining electrical charge of a transfer belt of an image forming apparatus, the method comprising:

charging a plurality of photosensitive media;

rotating a transfer belt, which contacts a surface of the plurality of photosensitive media, along an endless path by a drive roller and a steering roller;

applying a first voltage to a surface of the transfer belt to transfer an image from the surface of each of the plurality of photosensitive media to the transfer belt by an electrostatic force; and removing a residual electrical charge from the transfer belt using an electrical charge removing unit by applying an electrical charge having the same measure and timing to a residual electrical charge removing unit corresponding to the electrical charge to charge the plurality of photosensitive media, wherein the residual electrical charge removing unit comprises:

a residual electrical charge removing member disposed to be in contact with the outer surface of the transfer belt, supported by the steering roller used as a back-up roller.

19. The method according to claim 18, further comprising:

applying a second voltage to the residual electrical removing unit.

20. The method according to claim 19, wherein the steering roller is disposed opposite to the residual electrical charge removing unit with respect to the transfer belt to be used as a backup roller of the residual electrical charge removing unit.

21. The method according to claim 18, wherein the same voltage source charges the residual electrical charge removing unit and the plurality of photosensitive media.

22. An image forming apparatus comprising:

a plurality of photosensitive media to from a latent image thereon;

a transfer belt to rotate in a loop and to contact the plurality of photosensitive media and receive color images developed from the latent image formed on the photosensitive media;

a plurality of voltage applying rollers each disposed opposite to corresponding photosensitive media to maintain a voltage level to transfer the color images from the photosensitive media to the transfer belt;

a driving roller and a steering roller to rotate the transfer belt;

a residual electrical charge removing roller to remove a residual electrical charge from the belt; and a transfer voltage applying unit to apply a transfer voltage to the applying rollers and a corresponding voltage to the residual electrical charge removing roller.

23. The apparatus of claim 22, wherein the residual electrical charge removing roller is supported by the steering roller and the steering roller is grounded.

24. The apparatus of claim 22, wherein the residual electrical charge removing roller is disposed between the drive roller and a first photosensitive media to remove the residual electrical charge before the transfer of the color images to the transfer belt.

25. The apparatus of claim 22, wherein the transfer belt comprises a first portion to correspond to the plurality of photosensitive media and the plurality of voltage applying rollers, and a second portion to correspond to the driving roller and the steering roller, and the residual electrical charge removing roller is disposed on the second portion to correspond to the driving roller and the steering roller to remove the residual electrical charge from the belt.

26. The apparatus of claim 22, wherein the driving roller and the steering roller comprise a plurality of driving roller and a plurality of steering rollers, respectively, disposed at an entrance part and an exit part of the belt, and the residual electrical charge removing roller removes the residual electrical charge from the entrance portion of the belt.

* * * * *